US005755363A

United States Patent [19]

Gantner et al.

[11] Patent Number: 5,755,363

[45] Date of Patent: May 26, 1998

[54] DEVICE FOR DISPENSING A FLOWABLE MASS STORED UNDER PRESSURE IN A CONTAINER

[75] Inventors: Gebhard Gantner, Nenzing, Austria; Heinrich Steiner, Gams, Switzerland

[73] Assignee: Hilti Aktiengesellschaft, Fürstentum, Liechtenstein

[21] Appl. No.: 634,452

[22] Filed: Apr. 18, 1996

[30] Foreign Application Priority Data

Apr. 18, 1995 [DE] Germany ..... 195 14 370.1

[51] Int. Cl.[6] ..... B67D 83/00

[52] U.S. Cl. ..... 222/402.15

[58] Field of Search ..... 222/402.13, 402.15, 222/527

[56] References Cited

U.S. PATENT DOCUMENTS 4,432,474 2/1984 Hutchinson et al. ..... 222/402.15

4,505,335 3/1985 Hayba ..... 222/402.15 X 5,549,226 8/1996 Kopp ..... 222/402.15 X

FOREIGN PATENT DOCUMENTS 8611458 7/1986 Germany .

9402375 1/1995 Germany .

1045891 1/1964 United Kingdom .

*Primary Examiner*—Gregory L. Huson

*Attorney, Agent, or Firm*—Anderson Kill & Olick, P.C.

[57] ABSTRACT

A device for dispensing a flowable mass stored under pressure in a container (13) includes a handle (1) with a locking arrangement (3) at one end for coupling it to the container. The handle (1) has a manually operated trigger member (5) in a side of the handle for operating an outlet valve on the container (13). The handle (1) forms a recess (7) extending inwardly from the one end to be coupled to the container (13) toward an opposite end.

7 Claims, 2 Drawing Sheets

Fig. 3
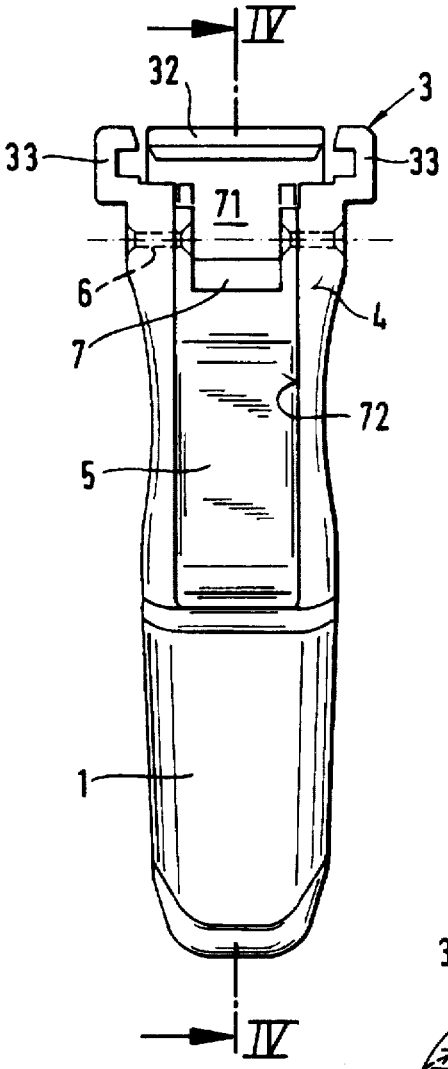
Fig. 4
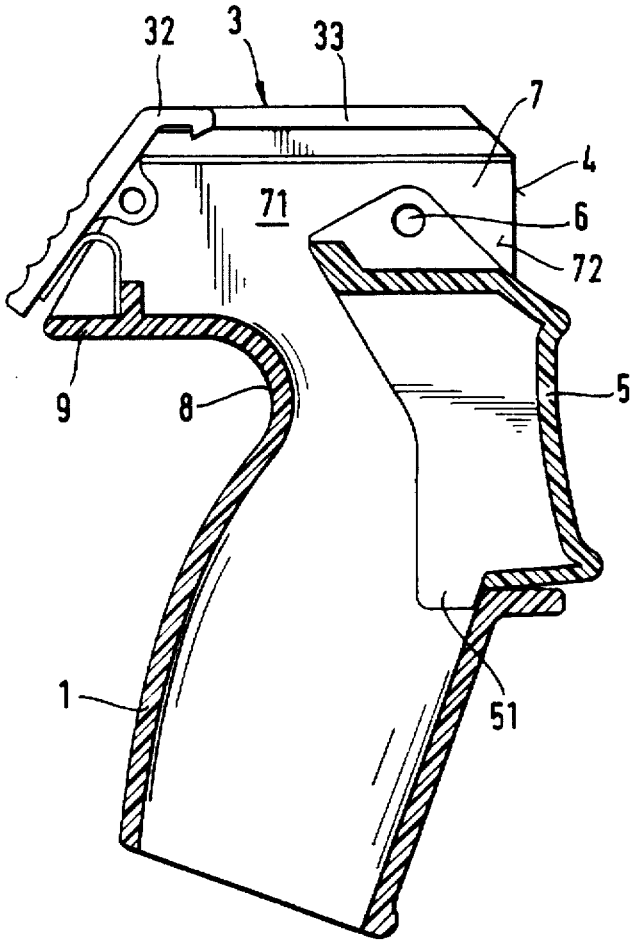
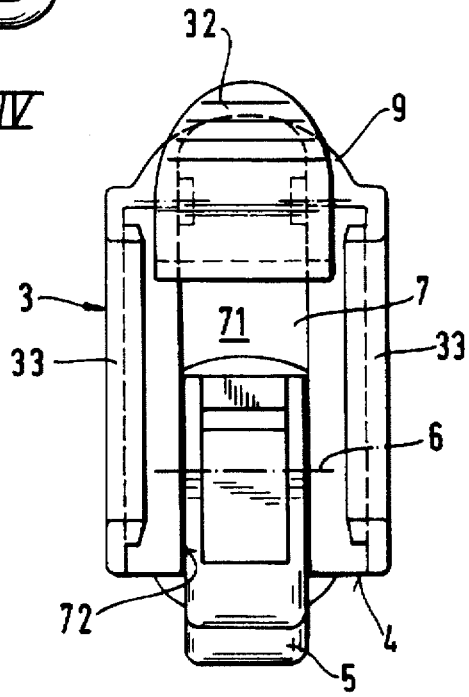
Fig. 5

DEVICE FOR DISPENSING A FLOWABLE MASS STORED UNDER PRESSURE IN A CONTAINER

BACKGROUND OF THE INVENTION

The present invention is directed to a device for dispensing a flowable mass stored under pressure in a container and the device includes a handle with a coupling means at one end for receiving the container and a manually operable trigger member in one side for operating a valve arrangement on the container.

It is often necessary in the construction and plumbing fields to close gaps and the like with a sealing mass. Polyurethane foams (PU-foams) are used mostly for this purpose and are stored in containers under pressure. Dispensing the PU-foam is effected by an outlet valve attached to the container. The valve can be operated by finger pressure on a pressure knob attached to the valve stem. To facilitate the dispensing of PU-foams from the pressurized containers, devices have been developed for the operator where the valve actuation is effected by a trigger member which can be placed on the valve stem. Based on this principle, devices have been developed which are intended to be reused. Such a known device includes a tubular handle provided with an outside thread at one end. A clamping nut is threaded onto the outside thread and serves as a coupling arrangement for a pressurized container. A slot-like recess is provided in the end face of the handle and the recess contains a triggering arm. The recess is closed by the triggering arm with only a small opening remaining in the region about the pivot axis of the arm. The upper edge of the recess is located below the end of the handle supporting the clamping nut and this end has a throughbore connected with the small opening in the end of the handle.

Before placing the device in use, the operator must attach the pressurized container on the end of the handle provided with the coupling arrangement and secure the container in position with the clamping nut. In this arrangement, the valve stem on the outlet valve extends into the throughbore in the handle. Accordingly, an elbow piece must be passed through the small opening in the end of the handle and placed with one of its ends on the valve stem. A flexible hose is fastened to the other end of the elbow piece for discharging the foam into difficult to reach areas. In this known device, it may be necessary to remove the trigger arm, so that the elbow piece can be placed on the valve stem. Subsequently, the trigger arm must be installed in the handle. After the pressurized container is connected to the handle and the elbow piece has been secured on the valve stem, the pressurized container is shaken repeatedly so that the PU-foam can be dispensed. To effect dispensing, the triggering arm is pivoted and presses against the elbow piece and actuates the dispensing valve located on the pressurized container.

The shut-off of the device takes place in a reversed sequence. The elbow piece is removed from the valve stem projecting from the pressurized container and is guided through the small opening in the end of the handle. Prior removal of the triggering arm may be necessary. Only after the elbow piece has been removed is it possible to separate the handle from the pressurized container. After the device has been used, the elbow piece is filled with PU-foam. When the elbow piece is removed, it is possible that the triggering arm and the handle are contaminated both inside and outside by the PU-foam. Primarily, there is the danger that the hands of the operator may come in contact with the polyurethane foam. In case of contamination with PU-foam, it must be removed as soon as possible before it hardens. Any contamination of the handle that is not removed, can impair the reuse of the device or make its reuse impossible.

Another disadvantage of the known device involves the relatively cumbersome assembly of the pressure container at the coupling arrangement. After the clamping nut has been attached to and removed from the coupling arrangement several times, it is not possible to properly secure the pressurized container. This can result in loss of the pressurized container when the device is in use. Further, when in use, the known device tends to cause comparatively rapid fatigue of the operator's hand and arm. The relatively long handle assembled with the pressurized container, tends, when used, to tilt out of the vertical position. This tendency to tilt must be absorbed by the wrist to assure proper operation without any malfunction. Due to the rapid tiring of the wrist, a permanent utilization, as required in professional applications, is considerably difficult.

SUMMARY OF THE INVENTION

Therefore, it is the primary object of the present invention to improve a device of the known type, so that the above disadvantages are eliminated. A device is to be afforded for dispensing flowable masses contained under pressure in containers which is comfortable to use and can be assembled and disassembled without any danger of contaminating the device. In addition, the operator is reliably protected from contact with the flowable mass, such as PU-foam, stored under pressure in the container. The pressurized container is to be easily and quickly assembled on and disassembled from the device. The device also is to assure a secure attachment of the pressurized container after repeated assembly and disassembly. It is to be suitable for professional application and to avoid any premature fatigue of the hand and arm of the operator.

In accordance with the present invention, a device for dispensing a flowable mass stored under pressure in a container includes an elongated handle equipped at one end, extending transversely of the elongated direction, with a coupling arrangement for a container with the handle having a manually operable trigger member in one of its elongated sides, so that the triggering member operates an outlet valve arrangement on the container. A recess is provided inside the handle extending from the end containing the coupling arrangement. The arrangement of the device embodying the invention permits a simple assembly. It is no longer necessary for the elbow piece to be mounted in a difficult manner through a small opening, rather, it can be placed on the valve stem prior to coupling the pressurized container to the handle. The trigger member does not need to be removed and again secured in place. Disassembly is also greatly simplified. Due to the inventive arrangement of the device, the handle can be detached from the pressurized container without the necessity of previously removing the elbow piece from the valve stem. The elbow piece placed on the valve stem can, together with the flexible hose, be removed through the recess in the handle containing the coupling arrangement where the recess extends inwardly from the end of the handle. As a result, contamination of the handle cannot take place and the operator is reliably protected from contact with the flowable mass, for instance, a polyurethane foam.

It is advantageous from a manufacturing point of view, if the portion of the recess extending into the handle is shaped as a receptacle for the trigger member. Accordingly, the tools for forming the handle can be designed in a relatively simple manner.

To make the handle as light as possible, it is advantageous that the recess extends across the end of the handle forming the coupling arrangement and continues inwardly into the handle in its elongated direction. A hollow design of the handle results in a weight saving. At the same time, the amount of material used for forming the handle is reduced. Due to the hollow arrangement of the handle, the trigger member can be disposed in the interior of the recess with a considerable portion of its structure located inside the handle. Only relatively small pivoting motion of the triggering member is necessary for actuating the outlet valve on the pressurized container. Due to the relatively close arrangement of the portion of the trigger member at the handle operated by the user, the operation of the trigger member can take place in a finger position permitting very accurate pressure metering.

In an advantageous embodiment of the inventive device, the handle, adjacent the end with the coupling means, has a bead or projection extending in the circumferential direction from the recess at an angle of approximately 90° toward the side of the handle opposite the side in which the trigger member is located. This projection extends outwardly from the handle and increases essentially from the sides adjacent the recess to the side opposite the recess and reaches a maximum dimension at the side opposite the recess. This projection has an abutment function when the device is in use. Accordingly, with the handle gripped by the thumb and the remaining fingers, the projection abuts at the region of the back of the hand between the thumb and the index finger. Accordingly, the weight of the handle and the pressurized container is more uniformly distributed over the hand and arm of the operator. The tendency of the handle to tilt sideways is greatly reduced with this type of grip. The wrist no longer needs to counteract the tendency to tilt in such a pronounced way whereby the wrist does not become quickly tired.

In another advantageous embodiment of the invention, the coupling means and on the handle for the container are provided with a quick acting coupling or a snap closure cooperating with a correspondingly designed coupling means on the container. Such an arrangement avoids fixing the pressurized container in a cumbersome manner by the use of clamping nut. With the use of a bayonet connection, a snap closure or the like, the container can be joined to the handle and, if necessary, can be detached from the handle with a minimum amount of manual effort. In place of a bayonet connection, a slide type block or a coarse thread can be used, which connections or locks cooperate with appropriately designed matching means on the container.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWINGS

In the Drawings

FIG. 3 is a front view of a second embodiment of the invention shown without the container;

FIG. 4 is a sectional view of the second embodiment taken along the line IV—IV in FIG. 3; and FIG. 5 is a plan view of the second embodiment of the invention.

DETAILED DESCRIPTION OF THE INVENTION

Figure 2:
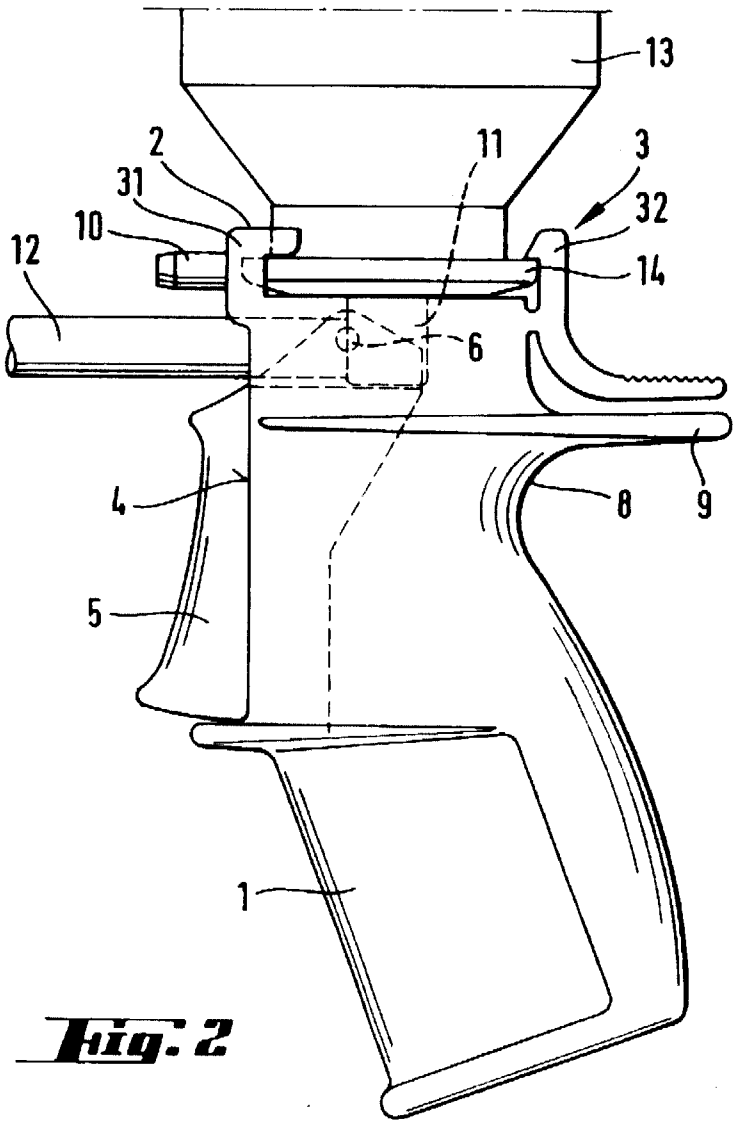
FIG. 2 is a side view of the embodiment shown in FIG. 1.
Figure 1:
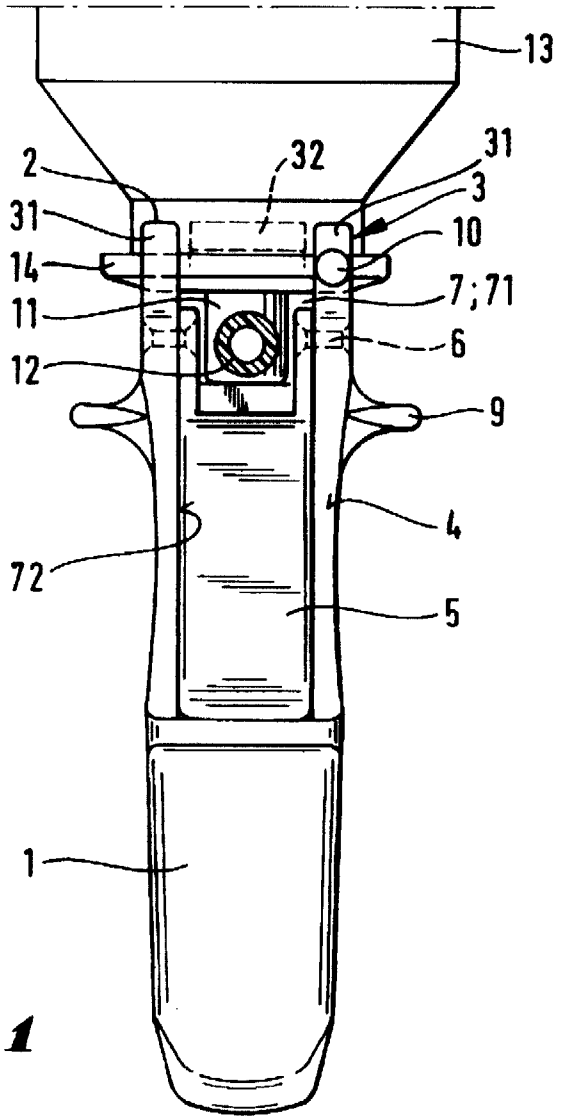
FIG. 1 is a front view of a first embodiment of the invention with a container mounted on the handle.

In FIGS. 1 and 2, a first embodiment of a device of the present invention is illustrated and comprises an elongated handle 1 having, as viewed in FIGS. 1 and 2, an upper first end 2 with coupling means for securing a container 13, only a portion of the container is shown in which a flowable mass to be dispensed is stored under pressure. The device is shown in an operational position with the container 13 and its outlet valve mounted in an inverted position on the coupling means 3. The coupling means 3 for the device in the first embodiment is formed of a snap lock made up of two stops 31 and a resilient locking pawl 32 providing a three point support. The stops 31 and the locking pawl 32 cooperate with correspondingly shaped mounting means 14 on the head end of the container 13 shown in FIG. 1.

The mounting means 14 is in the form of a circumferentially extending collar which engages beneath the stops 31 and is held down by the locking pawl 32 in its operational position. As can be seen in FIG. 2, the locking pawl 32 has a L-shaped locking arm which, when pressed downwardly, releases the container so that it can be removed from the handle.

As viewed in FIGS. 1 and 2, the handle 1 has a second end spaced downwardly from the first end and sides extending in the elongated direction between the first and second ends. A recess 7 extends downwardly from the first end 2 and is bordered laterally by the sides including a first side 4 and an opposite second side 8 and third sides extending between the first and second sides. In FIGS. 1 and 2, the recess 7 extends downwardly from the first side 4 for approximately half of the elongated dimension of the handle 1 and the recess is shaped as a receptacle 72 for a trigger member 5 pivotally connected to the handle 1 by the pivot means 6. The trigger member 5 does not extend across the full width of the first side 4 of the handle 1 and is spaced closely below the coupling means 3. The upper end of the handle 1 is bifurcated. An empty space 71 is located in the recess above the handle 1. The locking pawl 32 with its L-shaped arm is pivotally secured to the upper end of the second side 8 of the handle. The empty space 71 is located between the bifurcated upper end of the trigger member 5 and the laterally spaced stops 31 of the coupling means 3. The empty space 71 in the recess 7 affords an unhindered assembly of the container 13 to the handle 1 due to the unobstructed passage of an elbow piece 11 placed on the valve stem of the outlet valve located at the inverted top end of the container 13. A flexible hose 12 is secured to the elbow piece 11 so that the flowable mass can be dispensed into difficult to reach spots.

A generally circumferentially extending projection 9 disposed transversely of the elongated direction, extends along the third sides of the handle and the second side 8. The projection 9 is spaced closely from the first end 2 of the handle. As can be seen in FIGS. 1 & 2, the projection 9 increases in the direction outwardly from the third sides of the handle to the rear second side 8 with the outward extent of the projection being greatest across the second side 8. As a result, the greatest outward dimension of the projection 9 is across the second side 8 of the handle 1. During operation, the projection 9 rests on the back portion of the operator's hand located between the thumb and the index finger. A pin-shaped member 10 extends from the upper end of the first side 4 of the handle 1 and has an end section tapering inwardly. During operation, if there is a short interruption in dispensing of the flowable mass, such as PU-foam, located in the container, the free end of the hose 12, not shown, can be placed onto the pin-shaped member 10. This seals the mass located in the hose in an almost air-tight manner, so that it does not harden in the hose during such short interruptions.

The second embodiment of the inventive device, shown in FIGS. 3 to 5, is slightly modified compared to the first embodiment. The coupling means 3 at the first end 2 is formed two side guides 33 and a spring loaded locking pawl 32 extending transversely of the side guides at the upper end of the second side 8 of the handle. The coupling or locking means 3 formed as a sliding lock cooperates with similarly shaped mounting means on the container, not shown, which holds the flowable mass under pressure. For instance, outwardly projecting strips are provided on two opposite sides of the head of the container, so that they can be pushed into the side guides 33. Another strip ledge extending transversely of the two side ledges serves for engagement with the locking pawl 32. The inserted container is fixed in position by the spring molded locking pawl 32. When the locking pawl 32 is pressed inwardly toward the handle, the locking engagement is released and the container can be removed from the handle. The recess 7 extends between the two side guides 33 and downwardly into the space bordered by the first and second sides 4, 8 and third sides of the handle. The recess forms a receptacle 72 for the trigger member 5. The trigger member 5 is mounted at pivot axis 6 and for the most part is located within the handle 1 and at its lower end within the handle 1, the trigger member 5 has a stop 51 for limiting its movement out of the handle. As can be noted in FIG. 4, the handle is hollow and opens to the free space 71 of the recess 7. A projection 9 extends outward from the second side 8 of the handle 1, so that during operation the projection rests on the back of the operator's hand between the thumb and the index finger.

A simple installation or assembly is afforded by the device of the present invention. The elbow piece does not have to be mounted with difficulty through a small opening, rather it can be placed on the outlet valve stem before mounting the pressurized container on the handle. It is not necessary to remove and then reinstall the trigger member. The disassembly is also greatly simplified. Due to the inventive arrangement of the device, the handle can be removed from the pressurized container without having to pull the elbow piece off the valve stem. The elbow piece on the valve stem can be removed along with the attached flexible hose through the recess in the first side of the handle adjacent to the coupling device with the continuation of the recess extending into the handle from the first end. This arrangement eliminates any contamination of the handle and the operator is reliably protected from contact with the flowable mass, such as polyurethane foam. The device can be fabricated simply and economically. The handle can be formed of two half shells which can be manufactured in an injection molding process and assembled after installing the trigger member.

While specific embodiments of the invention have been shown and described in detail to illustrate the inventive principles, it will be understood that the invention may be embodied otherwise without departing from such principles.

We claim:

1. A device for dispensing a flowable mass stored under pressure in a container (13) having an outlet valve member, comprises a handle (1) having an elongated direction with a first end (2) extending transversely of the elongated direction and including means (3) for coupling the handle (1) to the container (13), a second end opposite said first end, said handle (1) having sides extending in the elongated direction from said first end and including a first side (4), a second side (8) located opposite and spaced from said first side, and a pair of spaced third sides extending between opposite edges of said first and second sides, a manually operable trigger member (5) mounted in said first side (4) and displaceable into said handle for operating the outlet valve member on said container (13), a recess located within said handle extending from said first end towards said second end and bordered by said first, second and third sides, said handle (1) comprises a circumferentially extending projection (9) extending outwardly from said handle transversely of the elongated direction thereof and, adjacent said means (13) for coupling the handle (1) to the container (13), said projection extending from adjacent said first side (4) along said third sides and said second side, and said projection increasing in width outwardly from said handle from adjacent said first side to a maximum along said second side (8).

2. A device, as set forth in claim 1, wherein said recess extending from said first end (2) towards the second end forms a receptacle (72) for said trigger member (5).

3. A device, as set forth in claim 1 or 2, wherein said recess extends from a free space (71) in said handle (1) located between said means (3) for coupling the handle (1) to the container (13) and continues in said handle towards said second end.

4. A device, as set forth in claim 1 or 2, wherein said means (3) for coupling the container (13) to said handle (1) comprises locking means (31,32,33) for cooperating with correspondingly arranged mounting means (14) on said container (13).

5. A device, as set forth in claim 4, wherein said means (3) for coupling comprises a pair of stops on said first end (2) of said handle (1) and a locking pawl (32) spaced from said stops and arranged to hold said container on said handle, and said pawl (32) being flexibly displaceable for releasing said container.

6. A device, as set forth in claim 4, wherein said means (3) for coupling comprises a pair of slide guides (33) for receiving cooperating members on said container, wherein said slide guides are located on opposite sides of said first end and extending in generally parallel relation, and a flexible pawl member (32) extending transversely of said slide guides and arranged to releasably lock said container.

7. A device, as set forth in claim 1 or 2, wherein a projection (9) extends outwardly from said second side (8) transversely of the elongated direction of said handle (1) and generally parallel with said first end of said handle (1).

* * * * *